US007497644B1

(12) United States Patent
Cohen

(10) Patent No.: US 7,497,644 B1
(45) Date of Patent: Mar. 3, 2009

(54) AUTOMATIC LIQUID BARRIER SYSTEM

(76) Inventor: Maurice Cohen, 555 NE. 34 St., Apt. 2002, Miami, FL (US) 33137

( * ) Notice: Subject to any disclaimer, the term of this patent is extended or adjusted under 35 U.S.C. 154(b) by 0 days.

(21) Appl. No.: 11/809,085

(22) Filed: May 31, 2007

(51) Int. Cl.
*E02B 7/50* (2006.01)

(52) U.S. Cl. ..... 405/96; 405/94; 405/104

(58) Field of Classification Search ..... 405/80, 405/87, 92, 94, 96, 97, 99, 100, 103, 104
See application file for complete search history.

(56) References Cited

U.S. PATENT DOCUMENTS 5,460,462 A * 10/1995 Regan ..... 405/96
5,725,326 A * 3/1998 Van den Noort ..... 405/104
6,425,707 B1 * 7/2002 Baxter ..... 405/87
6,485,231 B2 * 11/2002 Montgomery et al. ..... 405/92
6,514,011 B2 * 2/2003 Nomura et al. ..... 405/107
6,623,209 B1 * 9/2003 Waters, Jr. ..... 405/94
7,270,498 B1 * 9/2007 Albanese et al. ..... 405/104

* cited by examiner

*Primary Examiner*—Frederick L Lagman
(74) *Attorney, Agent, or Firm*—Malloy & Malloy, P.A.

(57) ABSTRACT

A liquid barrier system automatically deploys when a predetermined liquid level is attained, thereby preventing water or other liquid from entering a structure through an accessway, and automatically retracts when the liquid level recedes. The liquid barrier system includes a float housing assembly installed substantially below grade and adjacent an accessway to a structure. The system also includes a float assembly having a float which is positionable within a float housing relative to a liquid level in the housing. A barrier assembly includes a barrier interconnected to the float, and one or more seal members disposed along a periphery of an accessway. In a high water event, the float rises with the liquid level in the float housing thus causing the barrier to automatically deploy into a sealing engagement with the seal member(s) along the periphery of the accessway, thereby preventing the entry of fluid into the structure.

10 Claims, 4 Drawing Sheets

AUTOMATIC LIQUID BARRIER SYSTEM

BACKGROUND

The present disclosure is directed to a liquid barrier system structured to automatically deploy in high water conditions, so as to prevent water from entering a structure through an accessway, and to automatically retract when the high water condition subsides. The system is structured to be installed in conjunction with a new structure, or an existing structure may be retrofitted to incorporate the inventive system.

DESCRIPTION OF THE ART

Impending flood conditions may result from extended periods of rainfall which saturates or supersaturates the water table and/or cause rivers to crest and breach their banks, or from sudden torrential downpours as are often associated with tropical weather fronts which have the same impact over significantly shorter timeframes. In either case, a common response to imminent flood conditions is to construct one or more temporary barrier(s) to protect homes, stores, offices, and other structures from rising flood waters in order to prevent damage to personal and/or business belongings inside of such structures. For example, sandbags are often filled and placed along the periphery of a structure, particularly adjacent accessways located at or near ground level, such as windows and doors. Alternatively, or in addition to sandbags, temporary dikes or levees may be constructed outward of the perimeter of a structure so as to prevent flow from reaching the structure and/or to redirect floodwaters around the particular structure to a point downstream. Of course, in the event the water table becomes supersaturated, water may rise up above the ground level inside the perimeter of such a dike or levee, thereby providing a source of liquid to enter and damage the structure.

Yet another problem with reliance upon such a temporary barrier in response to an impending flood condition is that there is often a "run" on materials, i.e., sand and sacks needed to make sandbags, or other materials necessary to construct a temporary dike or levee. Even in the event the necessary materials are readily available, the construction of one or more temporary barriers is labor intensive and, thus, time consuming, such that it may not be feasible to construct a temporary barrier in advance of potential flood conditions. Furthermore, as the presence of such temporary barriers severely inhibits normal ingress and egress from a structure, they are normally removed once flood conditions subside, thus making it necessary to reconstruct anew in advance of each potential flood event. As a result, and as noted above, it may not always be feasible to construct a temporary barrier in time to prevent significant liquid infiltration into a structure and subsequent damage. The time factor is exacerbated in the case of a rapidly moving severe storm front which may cause unexpected flooding in certain areas, i.e. flash floods, in which there simply is not time to construct any temporary barriers in advance of flooding conditions.

As such, it would be beneficial to provide a barrier assembly that is structured to automatically deploy when conditions produce liquid levels above a predetermined level, wherein the barrier is structured to seal an accessway to a structure, thereby preventing infiltration of floodwater or other free flowing liquid into the structure. Further, it would be helpful if such an assembly were structured such that it automatically returned to a retracted, storage configuration once flood conditions subside, and liquid levels recede below the predetermined level. Another benefit may be realized by providing such a barrier assembly which may be installed adjacent an accessway to a structure in a manner that does not impede normal ingress or egress through the accessway, when the barrier assembly is not deployed in a sealing configuration. In addition, it would be preferable for such an assembly to be constructed so as to support heavy equipment traffic thereover when disposed in a retracted, storage configuration, such heavy traffic including, by way of example only, trucks, fork lifts, etc., such as may traverse an accessway at a commercial facility.

SUMMARY

As stated above, the present application is directed to an automatic liquid barrier system for an accessway, such as a door, window, or other opening into a structure located at, near, or below ground level. The present disclosure is intended for use in residential, commercial, manufacturing, or any other structure having at least one accessway which is susceptible to infiltration of liquid in a high water event, such as floodwater.

The system comprises a float housing assembly installed adjacent the accessway, the float housing assembly including a float housing having an inlet to permit liquid to enter and an outlet to permit liquid to exit. In the embodiments illustrated in the figures presented herein, the float housing is structured to be installed substantially below grade, however, it is envisioned that the float housing may be installed at least partially above-grade, such as in the instance where the lowest point of entry through an accessway is positioned at an elevation which is also above-grade.

In any event, the system includes a float assembly structured to be moveably received within the float housing. More in particular, the float assembly in accordance with the present disclosure comprises a float which is structured to be positionable within the float housing relative to a liquid level therein. That is to say, as water or other liquid enters the float housing through the inlet at a rate that is greater than the rate of discharge of liquid through the outlet, such as will typically occur when the water table is saturated or supersaturated, liquid will accumulate and rise within the float housing, thereby causing the float assembly, and in particular, the float, to rise relative to the liquid level within the float housing.

The system presented in the present application further comprises a barrier assembly including at least one barrier, the barrier being interconnected to at least a portion of the float assembly and being moveable therewith. In addition, the barrier assembly comprises at least one seal member mounted along at least a portion of a periphery of the accessway of the structure, the seal member being cooperatively structured with the barrier to form a sealing engagement about the portion of the periphery of the accessway. Of course, it is well within the scope and intent of the present disclosure for the barrier assembly to comprise a plurality of seal members to provide a sealing engagement with the barrier about a portion of the periphery of a large or irregularly configured accessway.

As stated above, the float assembly comprises a float which is positionable within said float housing relative to a liquid level therein, and the barrier is interconnected to at least a portion of the float assembly and moveable therewith. As such, the barrier is automatically deployed into the sealing engagement with the seal member along the portion of the periphery of the accessway when the float is positioned at a predetermined elevation within the float housing by a predetermined level of liquid therein. Further, the sealing engagement is at least partially defined by a liquid resistant seal being formed around at least the portion of the periphery of the accessway to prevent a liquid from entering therethrough.

BRIEF DESCRIPTION OF THE DRAWINGS

For a fuller understanding of the present disclosure, reference should be had to the following detailed description taken in connection with the accompanying drawings in which:

FIG. 4 is a plan view of one embodiment of a float assembly in accordance with the present disclosure.

Like reference numerals refer to like parts throughout the several views of the drawings.

DETAILED DESCRIPTION

Figures 1, 2:
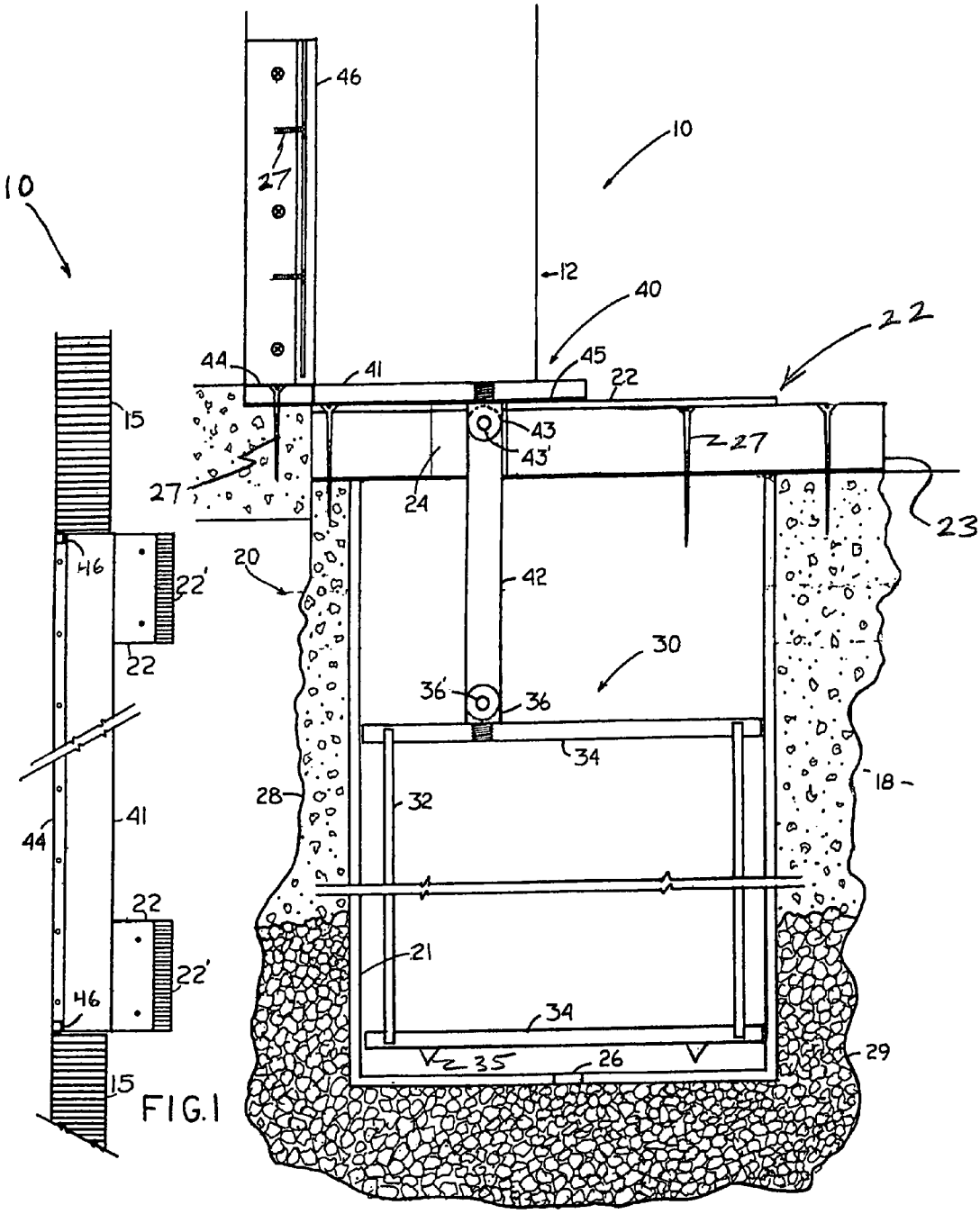
FIG. 1 is a plan view of one embodiment of an automatic liquid barrier system in accordance with the present disclosure.
FIG. 2 is an elevation of the embodiment of FIG. 1 illustrating a barrier assembly in a retracted disposition.

The present disclosure is directed to an automatic liquid barrier system for an accessway, as shown at 10 throughout the drawings. More in particular, the system 10 in accordance with the present disclosure is structured to prevent a flow of liquid, such as rain or flood water, into a structure via an accessway such as a door, window, or other opening through an external wall of the structure. Further, the present disclosure contemplates structures such as residential homes or apartments, office buildings, commercial properties, including for example, store fronts, warehouses, etc., as well as various industrial and manufacturing facilities. In fact, the system 10 is versatile enough to provide an automatic liquid barrier system 10 to protect any of the aforementioned structured, as well as other structures not specifically discussed herein.

To begin, the automatic liquid barrier system 10 includes a float housing assembly, as shown at 20 throughout the figures, installed adjacent an accessway into a structure. Further, and as shown in the illustrative embodiment of FIGS. 2, 3 and 6, the float housing assembly 20 comprises a float housing 21 structured to be installed substantially below grade. As noted above, however, it is within the scope and intent of the system 10 of the present disclosure for the float housing assembly 20 and/or the float housing 21 structured to be installed at least partially above-grade, such as may be necessitated in the case where the lowest point of entry through an accessway into a structure is at an elevation which is above-grade.

The float housing assembly 20 includes a cover assembly 22 which is structured to substantially overlay the upper portion of the float housing 21, thereby limiting access into the float housing 21 from the top. The cover assembly 22 includes at least one inlet 22', however, in at least one embodiment the cover assembly 22 of the float housing assembly 20 comprises a plurality of inlets 22', as illustrated best in FIGS. 1 and 5. In one embodiment, the inlet 22' comprises a strainer, screen, or filter member structured to readily permit the passage of liquid, but to prevent the passage of debris into the float housing 21 which may impede the operation of the system 10.

In addition, the float housing 21 includes at least one outlet 26 structured to permit liquid to exit therefrom. A strainer, screen, or filter member may be positioned across the outlet 26 to permit the passage of liquid, but prevent the inflow of underlying sediment or other materials into the float housing 21, which may occur in saturated or supersaturated groundwater conditions.

A further consideration with respect to the float housing assembly 20 is that the assembly 20 comprises a width which is generally about the same as the width of an accessway for which an automatic liquid barrier system 10 in accordance with the present disclosure is installed. Thus, it will be appreciated that the float housing assembly 20 comprises a width ranging from essentially the size of a single doorway structured to provide access for person's to enter and exit a structure, to the size of a large garage, loading dock or loading bay entrance designed for cars, trucks, heavy equipment, etc., to enter and exit a commercial, industrial, and/or manufacturing structure.

Figure 3:
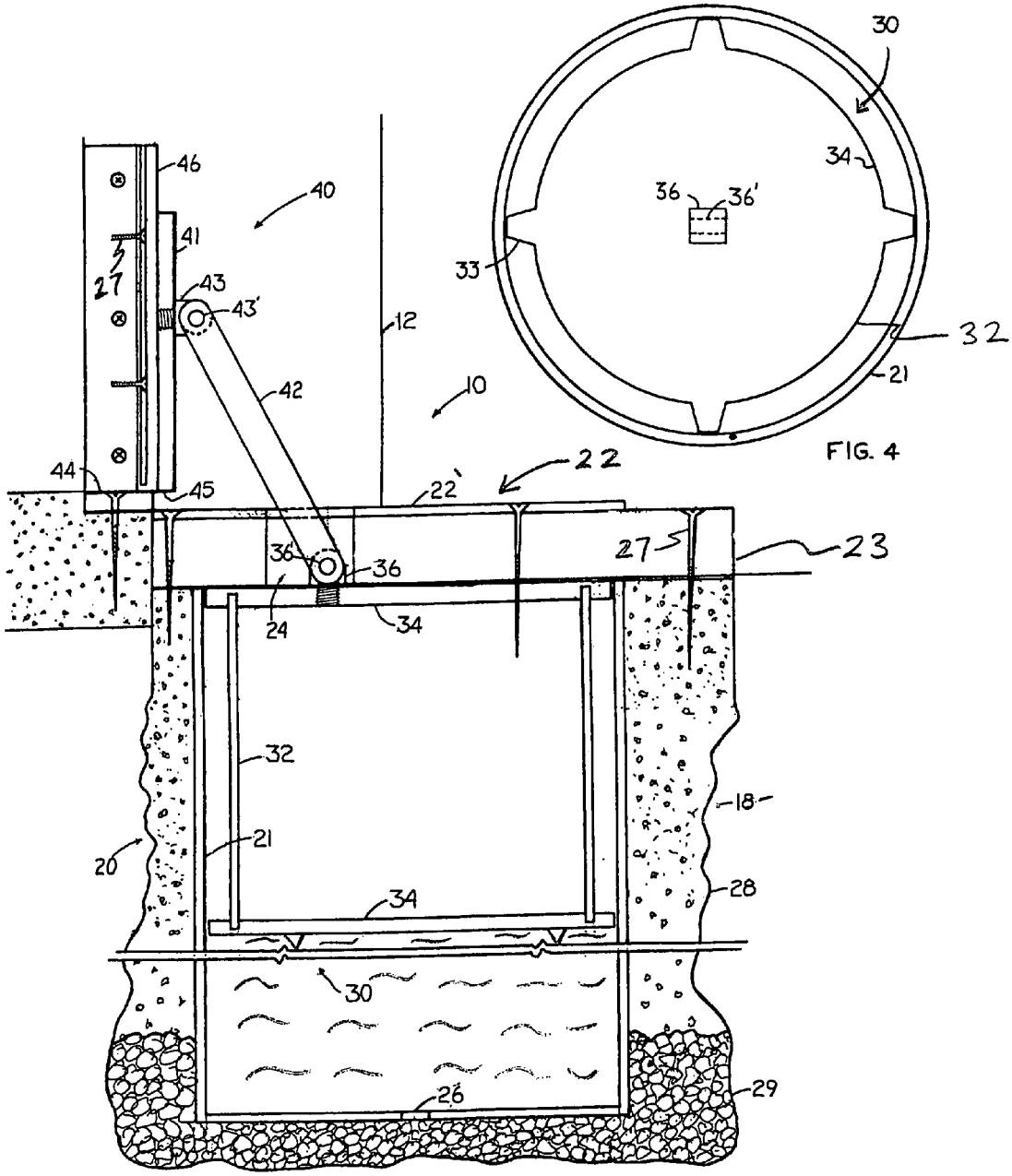
FIG. 3 is an elevation of the embodiment of FIG. 1 illustrating the barrier assembly in a deployed disposition.
Figure 6:
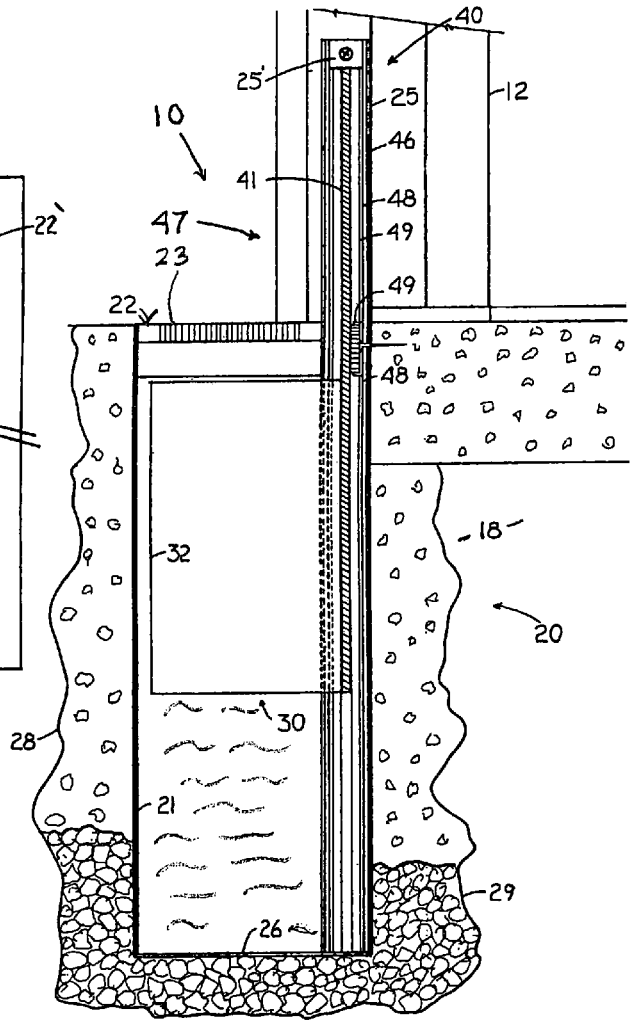
FIG. 6 is an elevation of the embodiment of FIG. 5 illustrating a barrier assembly in a deployed disposition.

Yet another consideration with respect to the float housing assembly 20 is that the assembly 20 is structured to support at least the design loads expected to pass thereover during normal entry and/or exit of the structure through a particular accessway. Specifically, when an accessway comprises a door, window, or other opening designed primarily for person's to enter or exit the structure, the float housing assembly 20, and more in particular the cover assembly 22, either alone or in combination with the corresponding float housing 21, is structured to support at least the normal design loading associated with such pedestrian traffic through the accessway. As such, the cover assembly 22 comprises a load bearing member 23, such as illustrated in FIGS. 2, 3, and 6, which overlays the float housing 21 and is structured to support at least the normal design loading associated with such pedestrian traffic during normal entry and/or exit of the structure via a particular accessway.

As noted above, in at least one embodiment the system 10 is structured to be installed adjacent a large accessway into a structure, such as, by way of example only, a garage door, a loading dock or loading bay entrance, etc. In such an embodiment, the float housing assembly 20, and once again in particular the cover assembly 22, must be structured to support at least the normal design loading as would be expected for heavy equipment traffic through such an accessway. For example, when the system 10 is installed adjacent a loading dock or loading bay entrance, the float housing assembly 20 must be structured to support at least the normal design loads associated with, by way of example only, cars, trucks, vans, loaded forklifts, fully loaded tractor trailers, and/or heavy construction equipment, which routinely enter or exit through such a loading dock or loading bay. Once again, the cover assembly 22 comprises at least one load bearing member 23 to accommodate the loads presented by such heavy equipment traffic. Furthermore, in the embodiment illustrated in FIGS. 2 and 3, the load bearing member 23 is structured to overlay and extend beyond the periphery of the float assembly 21 onto an underlying concrete encasement 28 which supports the load bearing member 23 and receives the loading forces transferred therefrom. More in particular, in at least one embodiment, the load bearing member 23 is substantially supported by the underlying concrete encasement 28, such that essentially all of the load applied to the cover assembly 22 is transferred from the load bearing member 23 to the concrete encasement 28, and not to the float housing 21.

Figure 5:
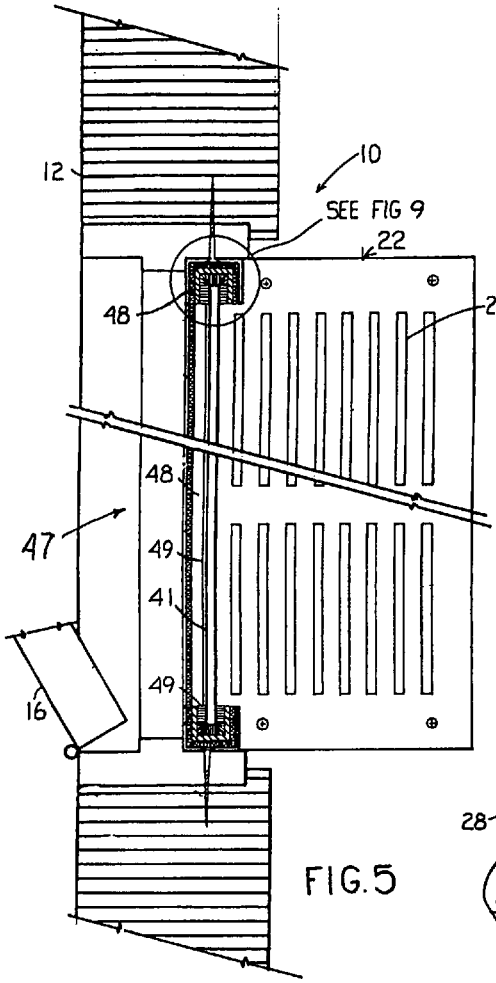
FIG. 5 is a plan view of another embodiment of an automatic liquid barrier system in accordance with the present disclosure.

In view of the wide range of potential loading requirements of the float housing assembly 20, a correspondingly wide variety of materials of construction are available for the same. For example, for smaller accessways, such as are utilized primarily for the entry and exit of personnel, such as through a door 16 as shown in FIG. 5, the materials of construction for the float housing assembly 20 include but are not limited to plastic materials, such as, high density polyethylene ("HDPE") and polyvinyl chloride ("PVC"), fiberglass, poured concrete, prestressed concrete, structural steel, or other metal or metal alloy. Of course, other materials having suitable structural properties can be utilized and remain within the scope and intent of the present disclosure.

In embodiments of the system 10 installed adjacent a large accessway, such as a garage door, loading dock or loading bay entrance, for example, the corresponding float housing assembly 20, and again in particular, the cover assembly 22, must be constructed of material having structural integrity to support the significant design loads expected to be placed upon and pass over such a structure. As such, in at least one embodiment, the load bearing member 23 of the cover assembly 22 comprises 2-inch thick grating constructed of structural steel. Additionally, in at least one embodiment, the float housing 21 itself is manufactured of poured or pre-stressed reinforced concrete, structural steel, or other metal and/or metal alloys as required to support the expected design loading for the accessway. Once again, the float housing assembly 20 and the components thereof are constructed of other materials provided the assembly 20 exhibits the structural integrity necessary for anticipated design loadings. Further, based upon the materials of construction, an appropriate mechanical fastener 27 is selected to secure the components of the system 10 to one another, as well as to secure the system in place adjacent an accessway to a structure.

As shown in FIGS. 2, 3, and 6, the float housing assembly 20 includes a concrete encasement 28 disposed in a substantially surrounding relation to the float housing 21 so as to provide further structural integrity and stability to the float housing 21 and the cover assembly 22 as required to accommodate specific design loads for a particular accessway. FIGS. 2, 3, and 6, further illustrate that in at least one embodiment, an underlying gravel bed 29 is installed under the float housing 21, so as to provide support for the aforementioned concrete encasement 28, as well as to facilitate drainage of liquid from the float housing 21 through outlet 26, when the surrounding soil 18 is not saturated or supersaturated. Also, as noted above, and as illustrated best in FIGS. 2 and 3, in at least one embodiment, the load bearing member 23 is structured to overlay and extend beyond the periphery of the float housing 21 onto the underlying concrete encasement 28, such that the concrete encasement 28, and not the float housing 21, supports the load bearing member 23 and receives the loading forces transferred therefrom.

The automatic liquid barrier system 10 further comprises a float assembly, shown as 30 throughout the figures. The float assembly 30 is structured and disposed to be positionable within the float housing 21. More in particular, in at least one embodiment, the float assembly 30 comprises a float 32 which is specifically structured to be positionable within the float housing 21 relative to a liquid level within the float housing 21, as discussed in further detail below. As the name implies, the float 32 comprises a buoyant structure which will float on liquid, for example, rain or flood water, which enters the float housing 21 via one or more inlet 22' through cover assembly 22. In at least one embodiment, the float 32 comprises one or more supports 35, such as are shown in FIGS. 2 and 3, which are structured to maintain the float 32 a spaced apart distance above the bottom of the float housing 21, thereby permitting liquid entering the float housing 21 to flow under the float 32, causing the float 32 to float upwardly as liquid accumulates thereunder.

Further, the float 32 comprises a substantially sealed structure so as to prevent the liquid, such as water, from entering the float 32 thereby causing it to sink or otherwise impeding its ability to float within float housing 21. For example, in the illustrative embodiment of FIGS. 2 and 3, the float 32 comprises float caps 34 affixed at either end which are structured to substantially close and seal the float 32, to assure it does not take on water or other liquid which would diminish or eliminate the buoyant properties of the float 32. As best illustrated in FIG. 4, in at least one embodiment, the float housing 21 comprises a substantially cylindrical configuration, and the float caps 34 comprise a plurality of guide members 33 extending outwardly therefrom being structured to insure that the float 32 remains in a concentric relationship with the circular cross-section of float housing 21. Also as shown in FIG. 4, the body of the float 32 is spaced apart from the periphery of the float housing 21 so as to allow liquid entering the float housing 21 to flow to the bottom of the housing 21 underneath the float 32, and to elevate the float 32 relative to the level of liquid in the float housing 21.

A further component of the automatic liquid barrier system 10 is a barrier assembly, as shown at 40 throughout the figures. More in particular, the barrier assembly 40 comprises at least one barrier 41, wherein the barrier 41 is interconnected to at least a portion of float assembly 30, and is structured and disposed to be movable therewith.

In the illustrative embodiment of FIGS. 2 and 3, the barrier 41 is interconnected to the float assembly 30 via an interconnect member 42. Further, and also as shown in FIGS. 2 and 3, float assembly 30 comprises interconnect mount 36, and barrier 41 includes interconnect mount 43 securely attached thereto. Additionally, in this embodiment, interconnect pins 36' and 43' are utilized to securely yet movably attach interconnect member 42 to each of the float assembly 30 and barrier 41, respectively. In at least one embodiment, interconnect mounts 36 and 43 comprise truions and interconnect pins 36' and 43' comprise pivot axles, thereby securely and pivotally attaching interconnect member 42 between the float assembly 30 and the barrier 41. In this manner, interconnect member 42 is permitted to pivot relative to both float assembly 30 and barrier 41 during an automatic deployment of the barrier 41 of the present system 10 from the retracted configuration of FIG. 2 to the fully deployed configuration of FIG. 3. The interconnect member 42 also pivots relative to both float assembly 30 and barrier 41 during an automatic retraction of the barrier 41 from the fully deployed configuration of FIG. 3 to the retracted configuration of FIG. 2. As further illustrated in the embodiment of FIGS. 2 and 3, cover assembly 22 includes interconnect aperture 24 structured to permit at least a portion of interconnect member 42 to pass freely therethrough.

Figure 8:
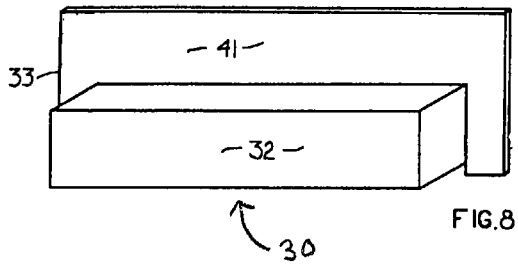
FIG. 8 is a perspective view of one other embodiment of a float assembly in accordance with the present disclosure.

In the embodiment illustrated in FIGS. 6 and 8, the float 32 is rigidly affixed to barrier 41 and, in at least one embodiment, the float 32 and barrier 41 are integrally constructed with one another so as to form a unitary construction. FIG. 8 further illustrates that in this embodiment, the vertical edges of barrier 41 serve as guides 33 to maintain the float assembly 30 in alignment with one or more seal channel 25 of the float housing 21, as discussed further below.

Looking further to FIGS. 1 through 3, barrier assembly 40 comprises at least one seal member 46 structured to be mounted along at least a portion of a periphery of an accessway, in accordance with the present disclosure. Of course, it will be appreciated, that the system 10 may comprise a plurality of seal members 46 each structured to be mounted along a different portion of the periphery of an accessway, particularly when the system 10 is installed to protect a large accessway such as, by way of example, a garage, loading dock or loading bay. More in particular, and with reference to the illustrative embodiment of FIG. 1, the system 10 includes a plurality of seal members 46 each mounted along opposite portions of door jamb 15 which frame an accessway into a structure through wall 12. The seal members 46 are secured along the periphery of the accessway in a liquid resistant manner, specifically, so as to prevent the infiltration of liquid between the seal member 46 and the structure to which is affixed. As shown in FIGS. 2 and 3, mechanical fasteners 27 may be utilized to secure the seal members 46 in a stationary manner along the portion of the periphery of the accessway, however, it will be appreciated that other methods of securing the seal members 46 in a stationary manner may be employed in the present system 10 including, at least, liquid resistant adhesives, hook and loop type fasteners, etc. Further, and as illustrated in FIG. 3, the seal members 46 are secured to the portion of the periphery of the accessway to a height which is greater than the vertical height of barrier 41 when disposed in a deployed configuration.

The operation of the automatic liquid barrier system 10 of the present disclosure will now be discussed in view of the embodiment illustrated in FIGS. 1 through 4. To begin, in a severe storm or other high water event, liquid, for example, rain or flood water, will enter the float housing 21 through inlets 22' in cover assembly 22, and more specifically, the liquid will enter the float housing 21 at a rate greater than it is discharged from the float housing 21 through outlet 26. As will be appreciated, in the event of a significant rain storm or other high water condition, wherein the water table is saturated and/or super saturated, the interstitial spaces in the gravel bed 29 will fill with ground water, thereby impeding the flow of liquid through outlet 26 and, thus, allowing for the accumulation of liquid within float housing 21. It is this accumulation of liquid in the float housing 21 which triggers the automatic deployment of the barrier 41 in accordance with the system 10 of the present disclosure. Specifically, as a level of liquid in float housing 21 increases, buoyant forces will cause the float assembly 30, and in at least one embodiment the float 32, to automatically rise vertically within float housing 21 from the fully retracted position illustrated in FIG. 2 to the fully deployed position illustrated in FIG. 3. Conversely, when the rain stops and groundwater levels subside, the level of liquid in float housing 21 will decrease and the float 32 is automatically lowered vertically within the float housing 21 from the fully deployed position illustrated in FIG. 3 to the fully retracted position illustrated in FIG. 2.

More in particular, and again as illustrated in FIG. 3, when liquid, such as rain water, accumulates in the float housing 21 to a predetermined liquid level, thereby positioning the float 32 of float assembly 30 at a predetermined elevation within the float housing 21, the barrier 41 will be deployed and disposed into a sealing engagement with seal member 46 as shown. FIG. 3 further illustrates the interconnection of barrier 41 to hinge plate 44, which is secured along the length of a lower periphery of an accessway, by a hinge member 45 as illustrated in FIGS. 1-3. Hinge member 45 comprises a flexible and liquid resistant material, so as to prevent the passage of liquid between the barrier 41 and hinge plate 44 thereby preventing the infiltration of liquid into the structure across the lower periphery of the accessway.

Looking further to FIGS. 2 and 3, we also see that interconnect member 42 at least partially passes through interconnect aperture 24 in a pivotal relationship between float 32 and barrier 41 during deployment of the barrier 41 into sealing engagement with seal members 46, as the float 32 rises vertically within float housing 21 relative to the rising liquid level therein. As used in the present disclosure and as recited in the claims which follow, "sealing engagement" is at least partially defined by a liquid resistant seal being formed around at least a portion of the periphery of an accessway to prevent a liquid from entering therethrough. In the illustrated embodiment of FIG. 3, the liquid resistant seal is formed by virtue of direct physical contact between the portions of barrier 41 and seal members 46 disposed vertically along the portion of the periphery of the accessway. Further, in this embodiment and as noted above, hinge member 45 extends along the length of the interface of hinge plate 44 and barrier 41, and is formed of a resilient liquid resistant material so as to provide a liquid resistant seal therebetween and, thus, along the lower periphery of the accessway.

Figure 7:
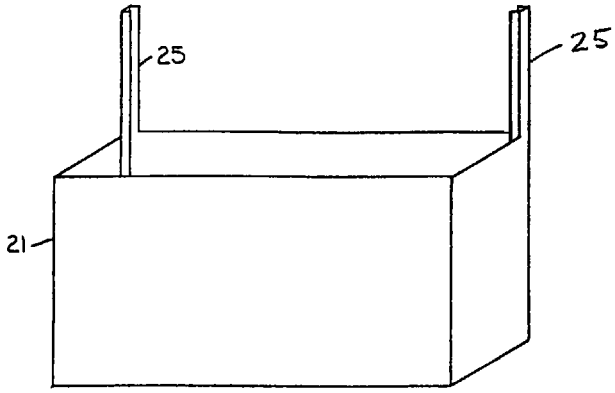
FIG. 7 is a perspective view of one embodiment of a float housing in accordance with the present disclosure.

In one alternate embodiment, barrier assembly 40 comprises at least one seal channel 25 disposed in a sealing relation along at least the portion of a periphery of the accessway, however, and as illustrated in FIGS. 5-9, the barrier assembly 40 of this embodiment comprises a plurality of seal channels 25 disposed along opposite portions of the periphery of the accessway. In order to ensure the sealing relation between the exterior of the seal channels 25 and the periphery of the accessway, one or more seal members 46 are secured between the exterior of the seal channels 25 and the periphery of the accessway to assure that liquid is not able to infiltrate between the exterior of the seal channel 25 and the periphery of the accessway. As illustrated in the embodiment of FIG. 7, float housing 21 comprises a plurality of seal channels 25 extending upwardly along opposite ends thereof. In this manner, each seal channel 25 is disposed in a sealing relation along opposite portions of the periphery of the accessway.

Figure 9:
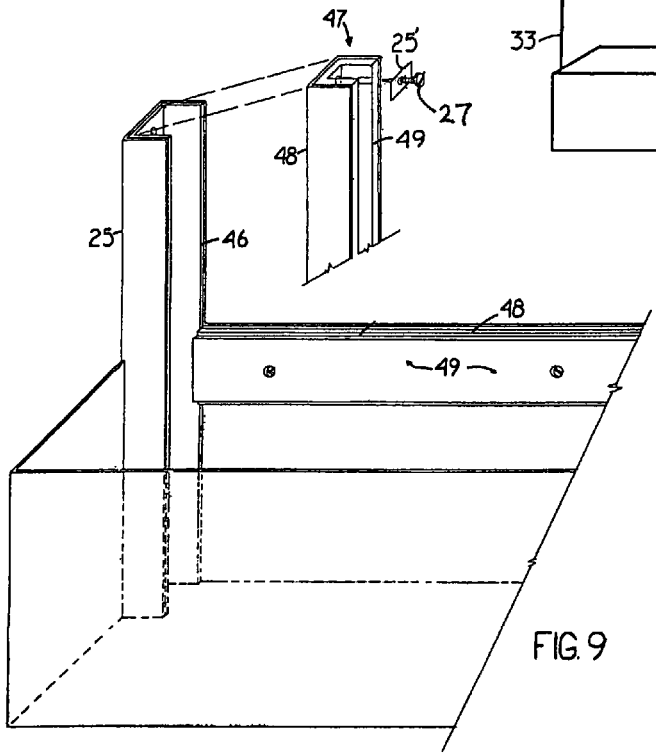
FIG. 9 is a partial exploded perspective view of one embodiment of a seal channel and a channel seal assembly in accordance with the present disclosure.

Further, in the embodiment illustrated in FIGS. 5-9, the barrier assembly comprises a channel seal assembly 47. More in particular, the channel seal assembly 47 is structured to be disposed in a sealing association with at least one seal channel 25, however, in at least one embodiment, the channel seal assembly 47 is structured to be disposed in a sealing association with each of a plurality of seal channels 25. Looking to FIG. 9, the channel seal assembly 47 comprises a channel seal track 48 having a channel seal member 49 disposed therein. More in particular, in the illustrated embodiment of FIG. 9, the channel seal track 48 comprises a generally U-shaped configuration having a corresponding generally U-shaped channel seal member 49 removably secured therein. Further, with continued reference to FIG. 9, the seal channel 25 of float housing 21 also comprises a generally U-shaped configuration structured to removably yet securely receive channel seal track 48, and the corresponding channel seal member 49, therein. FIG. 9, further illustrates that to assure the sealing association between channel seal assembly 47 and seal channel 45, one or more seal members 46 are secured between the interior of the seal channel 25 and the exterior of the channel seal assembly 47, thereby preventing infiltration of liquid between the seal channel 25 and the channel seal assembly 47. Also as shown in FIG. 9 is seal channel stop 25' secured in an upper portion of seal channel 25, such as by fastener 27, the seal channel stop 25' acting to limit the travel of the barrier 41 within the seal channel 25, as will be appreciated better in view of the discussion below. It is to be understood that the generally U-shaped configuration of the illustrative embodiments may be altered within the spirit and intent of the present disclosure so long as the required sealing relation and sealing association as described above are maintained between the corresponding components of the barrier assembly 40 to prevent the infiltration or other flow of liquid through or around the components of the barrier assembly 40.

As shown in FIG. 8, the barrier 41 of this embodiment is structured to extend outwardly from the vertical sides of the float 32 and into the generally U-shaped channel seal member 49 of the channel seal assembly 47, such that a sealing engagement is established between the barrier 41 and channel seal assembly 47 along at least a portion of the periphery of the accessway when float assembly 30 is positioned at a predetermined elevation within the float housing 21, as illustrated in FIG. 6. To further establish the sealing engagement between the barrier 41 along at least a portion of the periphery of the accessway, seal channel assembly 47 further comprises a channel seal track 48 secured horizontally along the upper rear portion of float housing 21, such as is illustrated in FIGS. 6 and 9, comprising a corresponding channel seal member 49 structured to establish a sealing engagement with the portion of the barrier 41 opposite the float 32. As it will be appreciated from the foregoing, in the alternate embodiment of FIGS. 5 through 9, a "sealing engagement" is established between barrier 41 and channel seal assembly 47, along at least a portion of the periphery of an accessway along its lowermost elevation and extending upwardly along each side therefrom, when a predetermined liquid level is present in the float housing 21 such that float 32 is positioned at a predetermined elevation within the float housing 21. As before, the "sealing engagement" is at least partially defined by preventing or at least minimizing infiltration of liquid through or around the barrier 41 and the channel seal assembly 47, thereby preventing the infiltration of liquid into the accessway of the structure.

Since many modifications, variations and changes in detail can be made to the described embodiments, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An automatic liquid barrier system for an accessway of a structure, said system comprising:

a float housing installed adjacent the accessway having a liquid inlet and a liquid outlet, a float assembly moveably received within said float housing, a barrier pivotally interconnected to said float assembly and moveable therewith, said barrier rotatably interconnected to a hinge plate via a flexible hinge member along substantially an entire length of a bottom periphery of the accessway, wherein said flexible hinge member comprises a liquid resistant material structured to substantially prevent a flow of liquid therethrough, said float assembly positionable within said float housing relative to a liquid level therein, and said barrier automatically rotating into a sealing engagement with a portion of a periphery along each side of the accessway when a predetermined liquid level is present in said float housing, wherein said sealing engagement is at least partially defined by a liquid resistant seal being formed between said barrier and the portions of the periphery along each side of the accessway and along the bottom periphery of the accessway to substantially prevent a liquid from entering therethrough.

2. The system as recited in claim 1 wherein said barrier is automatically rotated between a deployed configuration and a retracted configuration.

3. The system as recited in claim 2 wherein said barrier automatically rotates into said retracted configuration when said predetermined liquid level recedes from said float housing.

4. An automatic liquid barrier system for an accessway of a structure, said system comprising:

a float housing assembly comprising a float housing structured to be installed substantially below grade adjacent the accessway, said float housing comprising an upper periphery, a concrete encasement structured and disposed to be installed below grade in a substantially surrounding relation to at least a portion of said float housing, a cover assembly disposed in a substantially overlying relation to said float housing and comprising at least one load bearing member, said load bearing member structured to extend outwardly beyond said upper periphery of said float housing and operatively engage at least a portion of said concrete encasement such that said concrete encasement supports said load bearing member and receives loading forces transferred therefrom, said float housing assembly having a cover assembly comprising an inlet structured to allow liquid to enter said float housing, said float housing assembly further comprising an outlet structured to allow liquid to exit said float housing, a float assembly moveably received and disposed within said float housing, at least one seal member disposed along a portion of a lower periphery of the accessway to the structure, a barrier assembly having a barrier, said barrier interconnected to at least a portion of said float assembly and moveable therewith, said float assembly structured to rise vertically within said float housing corresponding to an accumulation of liquid within said float housing, and said barrier structured to be deployed into a sealing engagement with said at least one seal member along the portion of the lower periphery of the accessway when liquid accumulates in said float housing to a predetermined liquid level, thereby preventing liquid from entering the structure through the portion of the lower periphery of the accessway.

5. The system as recited in claim 4 wherein said barrier is rigidly interconnected to said float assembly.

6. The system as recited in claim 4 wherein said barrier is pivotally interconnected to said float assembly.

7. The system as recited in claim 4 further comprising a plurality of seal members disposed along the portion of the lower periphery of the accessway.

8. The system as recited in claim 7 wherein said barrier is structured to be rotated into a sealing engagement with said plurality of seal members along the portion of the lower periphery of the accessway when liquid accumulates in said float housing to a predetermined liquid level, thereby preventing liquid from entering the structure through the portion of the lower periphery of the accessway.

9. An automatic liquid barrier system for an accessway of a structure, said system comprising:

a float housing assembly installed adjacent the accessway, wherein said float housing is installed substantially below grade, said float housing assembly comprising a float housing having at least one inlet to permit liquid to enter and at least one outlet to permit liquid to exit therefrom, said float housing assembly further comprises a cover assembly, said at least one inlet being disposed therethrough, a float assembly moveably received within said float housing, a barrier assembly comprising a barrier, said barrier interconnected to at least a portion of said float assembly and moveable therewith, an elongated interconnect member independently and pivotally attached to a portion of each of said float assembly and said barrier at opposite ends thereof, said cover assembly comprising an interconnect aperture structured to permit at least a portion of said elongated interconnect member to pass therethrough, said barrier assembly further comprising a hinge plate having a flexible hinge member installed along substantially an entire length of a bottom periphery of the accessway, said barrier being rotatably interconnected to said hinge plate via said flexible hinge member, wherein said hinge member further comprises a liquid resistant material structured to substantially prevent a flow of liquid across therethrough, said barrier assembly comprising a plurality of seal members, wherein at least one of said plurality of seal members is mounted along at least a portion of each side periphery of the accessway, said float assembly positionable within said float housing relative to a liquid level therein, said interconnect member operative to rotate said barrier into a sealing engagement with at least a portion of the periphery of the accessway when said float assembly is positioned at a predetermined elevation within said float housing, and said barrier rotating into said sealing engagement with said plurality of seal members along the portion of each side periphery of the accessway when said float assembly is positioned at said predetermined elevation within said float housing by a predetermined liquid level therein, said sealing engagement at least partially defined by a liquid resistant seal being formed between said barrier and said plurality of seal members along the portion of each side periphery of the accessway and said flexible hinge member along substantially the entire length of the bottom periphery of the accessway, thereby preventing liquid from entering the structure through the portion of each side periphery and the bottom periphery of the accessway.

10. An automatic liquid barrier system for an accessway of a structure, said system comprising:

a float housing structured to be installed substantially below grade adjacent the accessway, said float housing comprising an upper periphery, a concrete encasement structured and disposed to be installed below grade in a substantially surrounding relation to at least a portion of said float housing, a cover disposed in a substantially overlying relation to said float housing and comprising at least one load bearing member, said load bearing member comprising a structural steel grating about two inches thick and being structured to extend outwardly beyond said upper periphery of said float housing and operatively engage at least a portion of said concrete encasement such that said concrete encasement supports said load bearing member and receives loading forces transferred therefrom, said float housing having at least one inlet to permit liquid to enter and at least one outlet to permit liquid to exit therefrom, said at least one inlet being disposed through said cover, a float moveably received within said float housing, a barrier interconnected to at least a portion of said float and moveable therewith, an elongated interconnect member independently and pivotally attached to each of said float and said barrier at opposite ends thereof via a corresponding interconnect mount, said cover comprising an interconnect aperture structured to permit at least a portion of said elongated interconnect member to pass therethrough, said barrier rotatably interconnected to a hinge plate along substantially an entire length of a bottom periphery of the accessway via a flexible hinge member, wherein said flexible hinge member comprises a liquid resistant material structured to substantially prevent a flow of liquid therethrough, a plurality of seal members wherein at least one of said plurality of seal members is mounted along at least a portion of each side periphery of the accessway, said float vertically positionable within said float housing relative to a liquid level therein, said interconnect member operative to rotate said barrier into a sealing engagement with at least a portion of the periphery of the accessway when said float is positioned at a predetermined elevation within said float housing, and said barrier rotating into said sealing engagement with each of said plurality of seal members disposed along the portion of each side periphery of the accessway when said float assembly is positioned at said predetermined elevation within said float housing by a predetermined liquid level therein, wherein said sealing engagement is at least partially defined by a liquid resistant seal being formed between said barrier and said plurality of seal members along the portion of each side periphery of the accessway and said flexible hinge member along substantially the entire length of the bottom periphery of the accessway, thereby preventing liquid from entering the structure through at least the portion of each side periphery and the bottom periphery of the accessway.

* * * * *